United States Patent [19]

van den Haak

[11] Patent Number: 4,869,193

[45] Date of Patent: Sep. 26, 1989

[54] ANCHOR

[76] Inventor: Rob van den Haak, Allegro 114, 2925 BG Krimpen a/d Ijssel, Netherlands

[21] Appl. No.: 220,983

[22] Filed: Jul. 15, 1988

Related U.S. Application Data

[63] Continuation of Ser. No. 911,048, Sep. 24, 1986, abandoned.

[30] Foreign Application Priority Data

| | | | |
|---|---|---|---|
| Sep. 27, 1985 | [NL] | Netherlands | 8502647 |
| Dec. 9, 1985 | [GB] | United Kingdom | 8530321 |
| Jan. 16, 1986 | [NL] | Netherlands | 8600081 |

[51] Int. Cl.[4] ..... B63B 21/24

[52] U.S. Cl. ..... 114/294; 114/297

[58] Field of Search ..... 114/293, 294, 297–303, 114/210; 294/66.1

[56] References Cited

U.S. PATENT DOCUMENTS

| | | | |
|---|---|---|---|
| 527,060 | 10/1894 | House et al. | 114/299 |
| 2,413,596 | 3/1944 | Wood, Jr. . | |
| 3,040,692 | 6/1962 | Hardy, Jr. . | |
| 3,809,001 | 5/1974 | Shute . | |
| 3,995,577 | 12/1976 | Gentry | 114/297 |
| 4,098,216 | 7/1978 | Bruce | 114/297 |
| 4,242,978 | 1/1981 | Fuller | 294/66.1 X |

FOREIGN PATENT DOCUMENTS

| | | | |
|---|---|---|---|
| 416272 | 7/1925 | Fed. Rep. of Germany . | |
| 67289 | 4/1985 | Japan | 114/210 |

*Primary Examiner*—Sherman D. Basinger
*Assistant Examiner*—Paul Salmon
*Attorney, Agent, or Firm*—Ladas & Parry

[57] ABSTRACT

A device for an anchor comprising an anchor shank, which anchor is to be handled by means of a chaser. The chaser is paid out to the anchor along an anchor line on a separate chaser line and seized on the anchor. The device comprises means arranged for turning the anchor with the chaser resting on an abutment provided on said means. The means is included in the assembly of said shank and the anchor line, thus allowing an in-line, arrangement of said means, the shank and the anchor line.

7 Claims, 7 Drawing Sheets

105
104
106
111

111
104
102
101

105
106
111

106
104
111
110

106
104
111

110

105
104
106
111
104
102
101

111

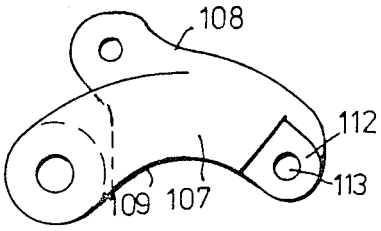
FIG. 8
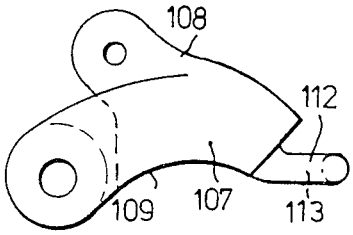
FIG 8A
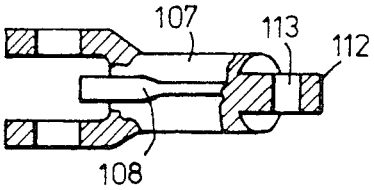
FIG. 9
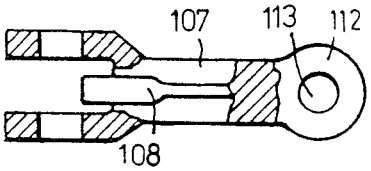
FIG. 9A
FIG. 10
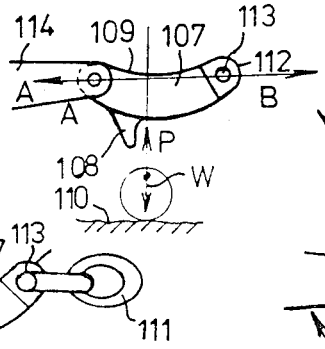
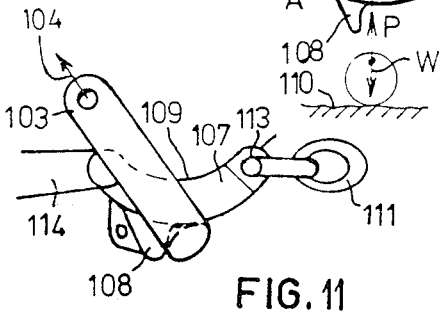
FIG. 11
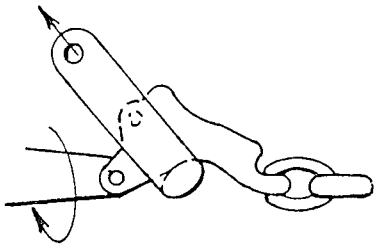
FIG. 11A
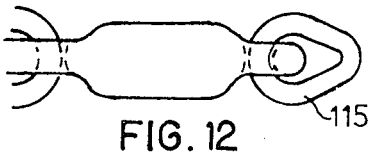
FIG. 12
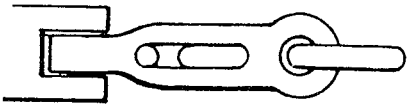
FIG. 12A

118'
104'
117'
116'
D'
120'
103'
C'
119'
111'

118'
104'
D'
120'

111'
104'
D'
C'

118'
104'
117'
D'
E
C'
E

117'
C'
D'
D'
103'

121'

ANCHOR

This is a continuation of co-pending application Ser. No. 06/911,048, filed on Sept. 24, 1986, abandoned.

BACKGROUND OF THE INVENTION

This invention relates to an anchor comprising a reinforced fluke, and fixedly secured thereon a twin shank substantially of V-shape in end view.

In prior anchors of this type the twin shank, due to the disposition of its legs, resists the soil flow and hence the penetration of the anchor into the ground and is accordingly incapable to contribute to any appreciable extent to the burying capacity of the anchor.

Bearing in mind that besides factors such as its weight and fluke surface area, a main factor to determine the quality of an anchor is its penetration or burying depth so that a deeply penetrating anchor will develop optimum holding power.

SUMMARY OF THE INVENTION

In an anchor of the aforesaid type according to the present invention the twin shank is disposed so that optimum holding force will be developed, the arrangement being so that the twin shank legs are of plate or structural foil shape and disposed substantially parallel or slightly rearwardly diverging in sections parallel to the main body of the fluke whereby, when the anchor penetrates into the ground, the soil flow will glidingly pass through the so formed shank tunnel, the fluke having rear stabilizers which are at a slightly negative angle of incidicence to the ground, and/or a front tip which is at a slightly positive angle of incidence to the ground so as to tip down the anchor on a steady penetration course to a great buried depth.

Accordingly, in the present anchor the twin shank is capable to contribute largely to the burying capacity of the anchor for optimum holding power which may be as high as 100 to 200 times its own weight whereas thus far a holding power of 50 times the anchor weight was considered exceptionally high.

Preferred is an embodiment of the present anchor whereby the rear stabilizers comprise a pair of substantially delta-shaped ground slides, and whereby the front tip has front stabilizers formed by a digger adapter, to prevent both fore and aft and lateral canting, and for deep digging in a sliding motion.

Of further advantage is an embodiment whereby the shank legs are mounted on a shank attachment box on the fluke for adjustment at angles from 30° to 50° with respect to the main body of the fluke for rock and soft ground, respectively, and whereby the fluke is double-walled with web reinforcement. Due to this sturdy and rigid construction the present anchor is of great strength and quite capable to withstand the extremely high holding force it develops, whereby auxiliary flukes are mounted between the shank legs to tie said legs and to provide additional holding area.

In a preferred embodiment said auxiliary flukes are structural foils providing negative lift when penetrating into the ground, whereby an auxiliary fluke between the shank legs at the shank to is closed fore and aft below the anchor shackle eye so that the soil flow is streamlined through the tunnel passages and no clogging of soil will be experienced at the V-top where the shank legs meet. In this respect the aforesaid slight rearward divergence ofthe shank legs, and also vertically between the auxiliary flukes, may be helpful to promote a smoother passage of the soil in view of the fact that soil particles when compressed have a tendency to break up in a greater number of smaller particles which occupy more space so that the soil then somewhat expands which phenomenon is called dilatation of soil under compression.

To cut its way through the soil, and particularly through hard soil and even rocky ground, at least one precutter is provided on the tip and/or the lateral sides of the fluke and/or on each of the shank legs for a saw-like action.

A further development according to the present invention resides in a provision for an anchor which is to be heaved and also to be laid out by means of a chaser, to be payed out to the anchor along an anchor line on a separate chaser line, and to be seized on the anchor.

The use of such a chaser with chaser line would often be preferred above the use of the pennant as the pennent-line remains connected to the pennant-eye and is to be marked for its recovery by a buoy which constitutes an obstacle in the sea and should be beaconed to avoid collisions and infliction of damage, whereas the chaser and chaser line are to be brought out only when the anchor is to be heaved and accordingly constitute no permanent obstacle in the sealane.

The chaser is brought out so far until it abuts on the ground-implement to be heaved and may, hence seized thereon, act then to pull the anchor loose, in a sense substantially opposite to the anchor line, and out of the ground in the same sense as this is done on the pennant.

But also when bringing out the anchor the chaser can function.

It has appeared useful in said operations with a chaser that the anchor is to be orientated with its fluke tips in a predetermined desired sense and thereto, according to the present invention, the measure is taken that means are present to turn the anchor with the chaser resting on its abutment so that the anchor when hauling it on board is to be turned with its fluke tips off the ship to prevent damage, and to particularly also turn an anchor which would come to rest on the ground with its fluke tips directed upwardly, so that it can be pulled into the ground.

Said new measure consists in its preferred embodiment in that the anchor line-eye is formed in an arcuate member connected to the anchor shank and having an abutment for a chaser which when it comes to rest on the abutment, when pulling on the chaser, turns the anchor 180° about its axis and will seat in the arch of the arcuate member. For a proper turning action it would thereby be preferred that the arcuate member is integrated with the anchor line, or that the arcuate member is formed as a separate member, particularly configured in the form of a harp shackle, which is to be connected with a second (harp shackle) eye provided at its end opposite to the anchor line-eye with a pin with an eye in the anchor shank, in which latter possible embodiment it would be preferred that the arcuate member has formed on its backside at least one abutment cam whereon the chaser comes to rest.

It is observed that the herein presented provision could also be of use in other respects, particularly by kinematic reversal of the measure as provided.

With the use of a chaser also the chaser fixation has become of importance and as a further provision for that purpose a device is arranged near the fairlead, comprising two pairs of catcher levers to catch the chaser at hinge pintles, one of said levers being longer than the other of said levers so that the chaser will be turned free of the chain at said hinge pintles. In its preferred embodiment said catchers are connected by a piece of flat.

The invention is explained in more detail in the following specification in view of illustrative embodiments thereof as represented in the drawing, which should, however, not be interpreted in a restrictive sense.

Figure 6:
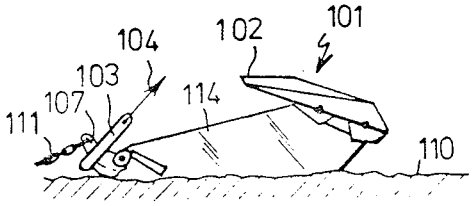
Figure 7:
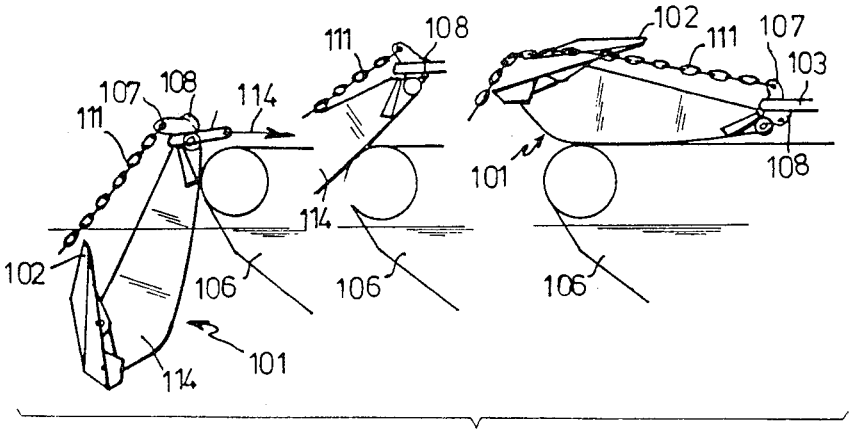

FIGS. *4a–4h* schematically illustrates the operation of a chaser on an anchor with a one-sided action, whereby the ability to orientate the anchor is particularly of importance;

FIGS. *5a* and *5b* are schematic representations of an anchor substantially depending on the anchor line and the chaser, respectively, and being turned;

FIG. 6 shows an anchor which has come to rest in reversed position in an undesirable manner, and which due to the new provision is to be turned by means of a chaser so as to be pulled with its fluke tips into the ground;

FIG. 7 shows an anchor which is turned with the chaser, when bringing it on board, so as to prevent damage;

FIGS. 8, *8a*, 9 and *9a* illustrate an arcuate anchor member according to the present invention, which is formed as a harp shackle;

FIGS. 10, 11 and 11a show a diagram of the forces acting thereon;

FIGS. 12 and 12a show a shackle with pear eyes;

FIGS. *13a–c* show the chaser fixation near the fairlead; and

FIGS. *14a–f* show another embodiment.

DESCRIPTION OF THE PREFERRED EMBODIMENTS

As depicted in the drawing the anchor 1 has a fluke 2 and attached thereon a twin shank 3.

The fluke 2 is a substantially delta-shaped hollow double-walled structure having top and bottom walls 4 and 5 jointed to form lateral sides 6 and 7 and a fluke tip 8 and reinforced by a bracing of webs 9.

The rear end of the fluke 2 is truncated at 10 and the rear stabilizers are formed by a pair of delta-shaped ground slides 11.

The fluke tip 8 has a front stabilizer 12 attached thereto, preferably in the form of a digger adapter as illustrated in the drawing.

The rear and front stabilizers 11 and 12 cooperate to keep the anchor 1 in a stable position on the ground on its fluke 2 which is so prevented from canting fore and aft as well as laterally.

The front stabilizer 12 is of a forwardly and downwardly inclined configuration so as to present a positive angle of incidence to the ground, which in cooperation with the above described negative angle of incidence to the ground presented by the rear stabilizers provides a negative lift to tip down the fluke 2 so that it is adapted to penetrate deep into the ground and promote the holding power of the anchor 1.

The shank 3 defines a tunnel passage 13 between its legs 14 which are substantially parallel or slightly rearwardly and upwardly diverging and are tied by preferably foil-shaped auxiliary flukes 15 which are substantially parllel to or slightly rearwardly and upwardly diverging from the main body of the fluke 2 so as to promote a tunneled soil flow through the twin shank 3 due to which the twin shank 3 will largely contribute to a deep penetration of the anchor 1 on a sliding downwardly bending course to a substantial buried depth for optimum holding power rated at 100–200 times the anchor weight.

As schematically illustrated the auxiliary flukes 15 of foil-shape are adapted to provide a negative lift so as to further promote the deep penetration and high holding power of the present anchor.

It is noted that the above described slight rearward divergence of the shank legs 14 and auxiliary flukes 15 would promote the smooth soil flow through the tunnel passages 13 as soil particles, when compressed, have a tendency to break up in a greater number of smaller particles so that the soil would expand under compression which expansion is compensated for by the divergence of said passages 13 in the soil flow direction i.e. rearwardly and upwardly.

The uppermost auxiliary fluke 15 at the shank top is preferably forwardly and upwardly closed below the anchor shackle eye 16 to streamline the flow into the uppermost tunnel passage 13 and prevent clogging in the V-corner 17 at the shank top line 18 where the shank legs 14 meet.

As illustrated, the shank legs 14 are secured to a shank attachment box 19 which is erected on the fluke 2. The shank legs 14 are bolted to said box 19 and adjustable at angles from 30° to 50° for rock and soft ground, respectively. The rear side of this structure is radiused at 20 about the main anchor shank bolt or king pin 21 as illustrated.

As a further provision the anchor 1 has at least one precutter 22 formed on its sides 6, 7 and/or on its tip 8 and/or on each of the shank legs 14 so that it is adapted to cut its way through the ground.

Figures 4A, 4B, 4C, 4D, 4E, 4F, 4G, 4H:
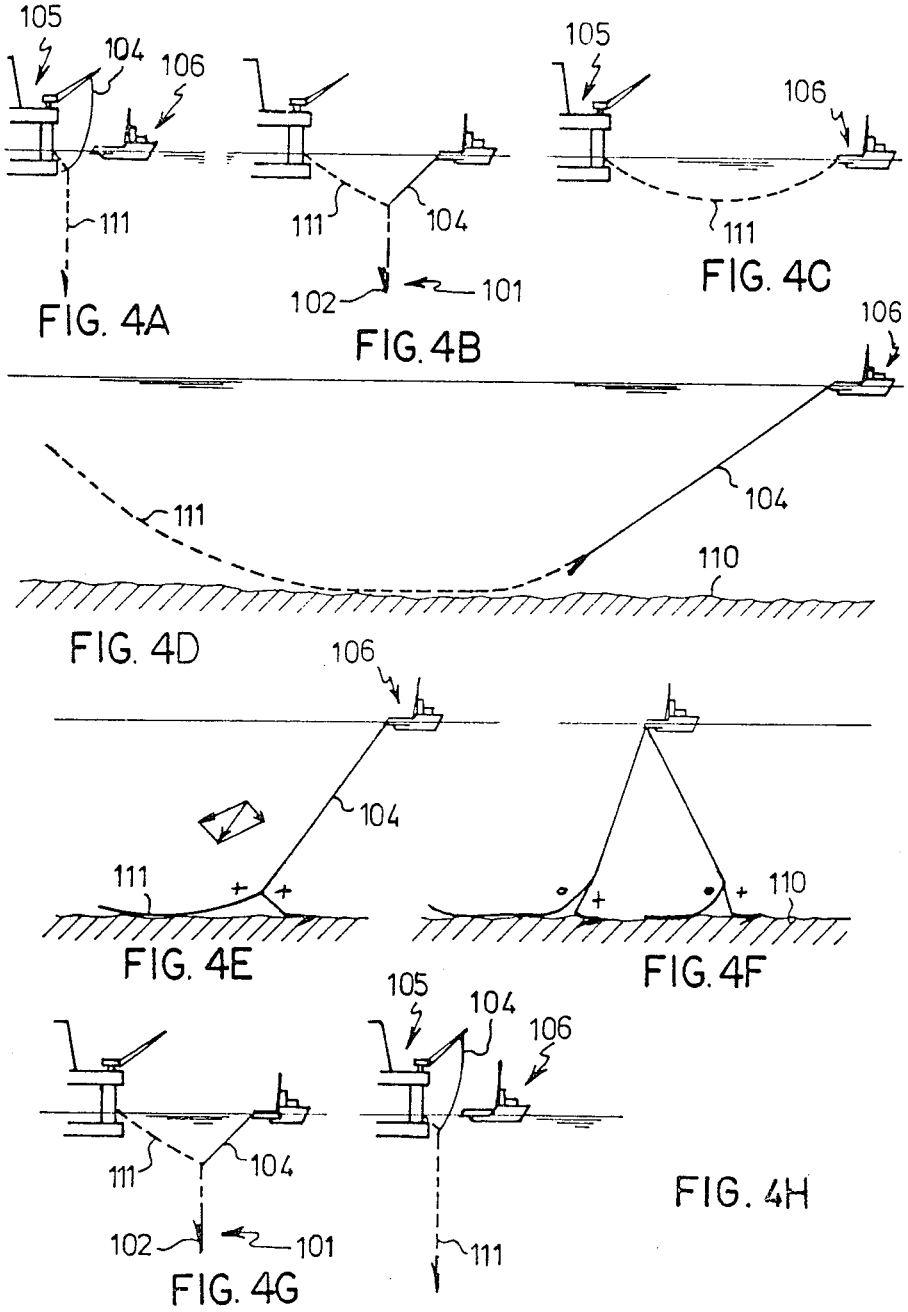

A further aspect of the newly invented anchor arrangement is for an anchor 101 as represented in FIGS. 4 and 5 having a one-sided action so that the hereafter disclosed measure for turning it in the desired position is useful.

With the ever growing dimensions of offshore operating drilling rigs also the mooring forces and hence the anchor weights are considerably increased.

The result is that the anchor becomes very difficult to handle by the workship or supply vessel serving such a drilling rig. The demand for anchors with an ever increasing effectiveness is growing in the last decennia. Recently an anchor with one-sided action has been introduced, which has increased the effectiveness with a factor of more than four and handling instuctions of such an anchor have to be followed carefully.

The anchors are stowed on board of the drilling rigs normally in anchor racks arranged alongside the rigs, with the fluke tips turned to inboard.

On board of the supply vessels the anchors are hauled on board by means of the pennant-wire, with the rear wide leading, so that the fluke tips will not damage the vessel. With anchors acting on one side it is necessary, so as not to inflict damage, to turn the anchor with its fluke tips outardly when hauling it on board. This is also contrary to the requirement when bringing it on board a drilling rig, to rack the anchor with its fluke tips inwardly directed.

As is already set forth in the foregoing, particularly in deeper water, mostly a chaser is being operated with, because the pennant-lines become too heavy and are ever more prone to get damaged.

In the drawing, the anchor is indicated at 101 and its fluke tips at 102 and the chaser is designated with 103 and the chaser line with 104. At 105 is indicated a drilling rig and at 106 a work or supply vessel serving the drilling rig 105.

To turn the anchor 101, when hauling it on board the workship 106, according to the present invention, use is made of a banana-shaped member 107 with a back cam 108 onto which the chaser 103 will abut, when lowered to the anchor 101 on the chaser line 104, so as to turn then the banana 107 and therewith the entire anchor 101. Upon turning the chaser 103 will seat then in the inner arch 109 of the banana 107.

The principle is that due to the force P applied by the chaser 103 between the locations A and B as represented in FIG. 10, the anchor implement is turned, which under the anchor weight W then works itself with its fluke tips 102 into the ground 110.

Figure 5A:
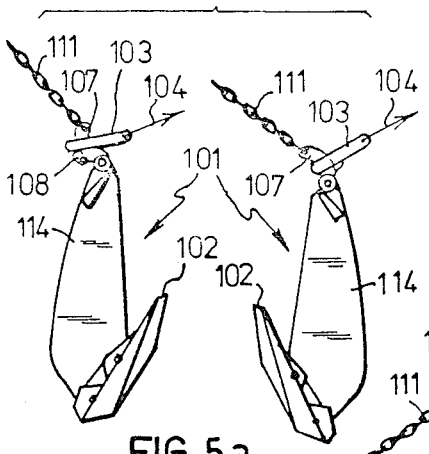
Figure 5B:
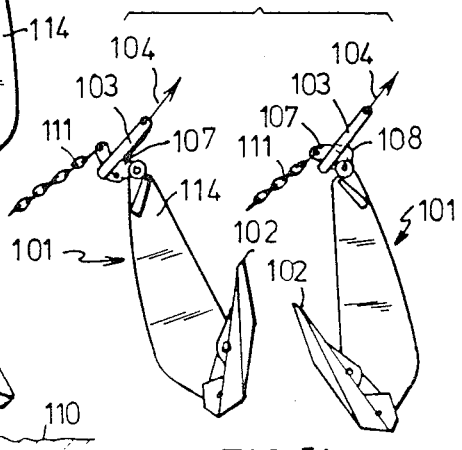

The course of action with the anchor 101 depending on the anchor line 111 and chaser line 104, respectively, is represented in FIGS. 5*a* and 5*b*.

FIGS. 8, 8*a*, 9 and 9*a* shows in more detail the configuration of the banana or arcuate member 107 which, as also depicted in FIGS. 8, 8*a*, 9 and 9*a*, has a substantially semi-circular transverse section.

It is observed that the herein disclosed arcuate member 107 which has at its outer end 112 the anchor line eye 113 therein, could also be fixedly connected to the anchor shank 114.

Furthermore links 115 in the form of pear eyes could be used, which are universally pivotal.

The chaser device is also useful for turning an anchor in the ground when heaving it. The anchor shank could then be provided with abutments for the chaser.

With the use of chasers also the fixation near the fairlead has become important. Originally the chaser was simply hooked up at a knee fixed to the fairlead.

More and more the chain was situated steeper than the original 45 degrees and it was impossible to create a hook for the chaser. The chaser stayed in contact with the chain and when the chain was paid out or retrieved some meters, often the chaser was forgotton and damage was the result.

Figure 1:
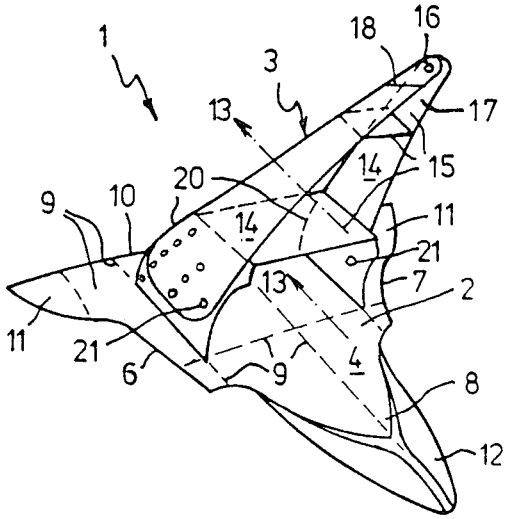
FIG. 1 is a perspective view, in schematic outlines, of a twin shank anchor according to the present invention.
Figure 13A:
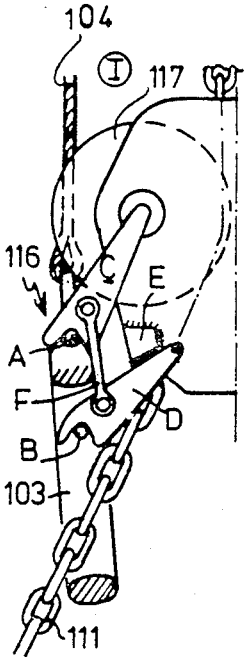
Figure 13B:
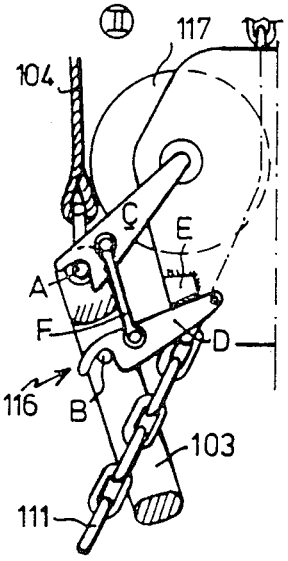
Figure 13C:
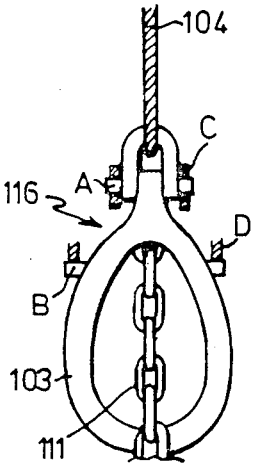
Figure 2:
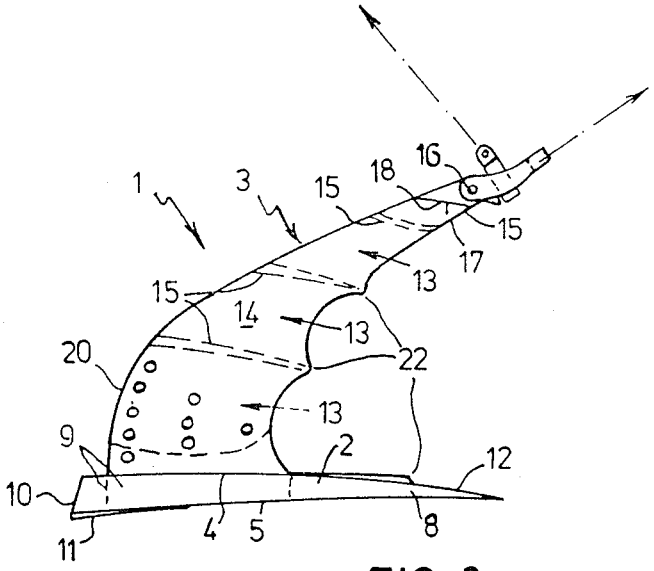
FIG. 2 is an elevation of a further embodiment of the present anchor.
Figure 3:
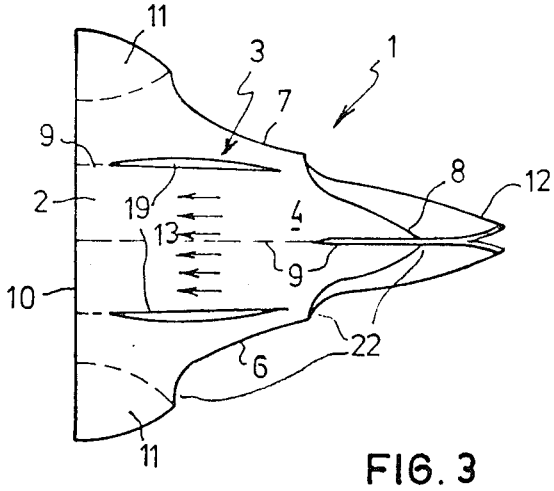
FIG. 3 is a schematic drawing in plan view of the disclosed anchor.

FIGS. 13*a*–*c* show a new device 116 for fixation of the chaser 103 near the fairlead 117, which fixation device 116 comprises two pairs of catcher levers C, D to catch the chaser 103, when hauling it on the chaser line 104, at the hinge pintles A, B. As lever C is longer than lever D the chaser 103 will be turned free from the chain 111 and from the fairlead 117 at said hinge pintles A, B. To limit the chaser movement an abutment E is mounted at the fairlead 117.

The catchers C, D are preferably connected by a piece of flat F.

FIG. 14 shows another embodiment of a chaser fang arranged at the fairlead 117' and indicated at 116' and comprising levers C' engaging about the anchor chain 111' and to which further levers D' are hingedly connected, which by means of an operating line 118' are pivoted in the stowage position.

To the chaser 103', as represented, the chaser line 104' is connected.

The levers C' and D' have fitting recesses 119' and 120', respectively, for receiving the upper and lower edges, respectively, of the chaser 103', the lower edge of which is covered on the inner side with rubber material as indicated at 121'.

Figures 14A, 14B, 14C, 14D, 14E, 14F:
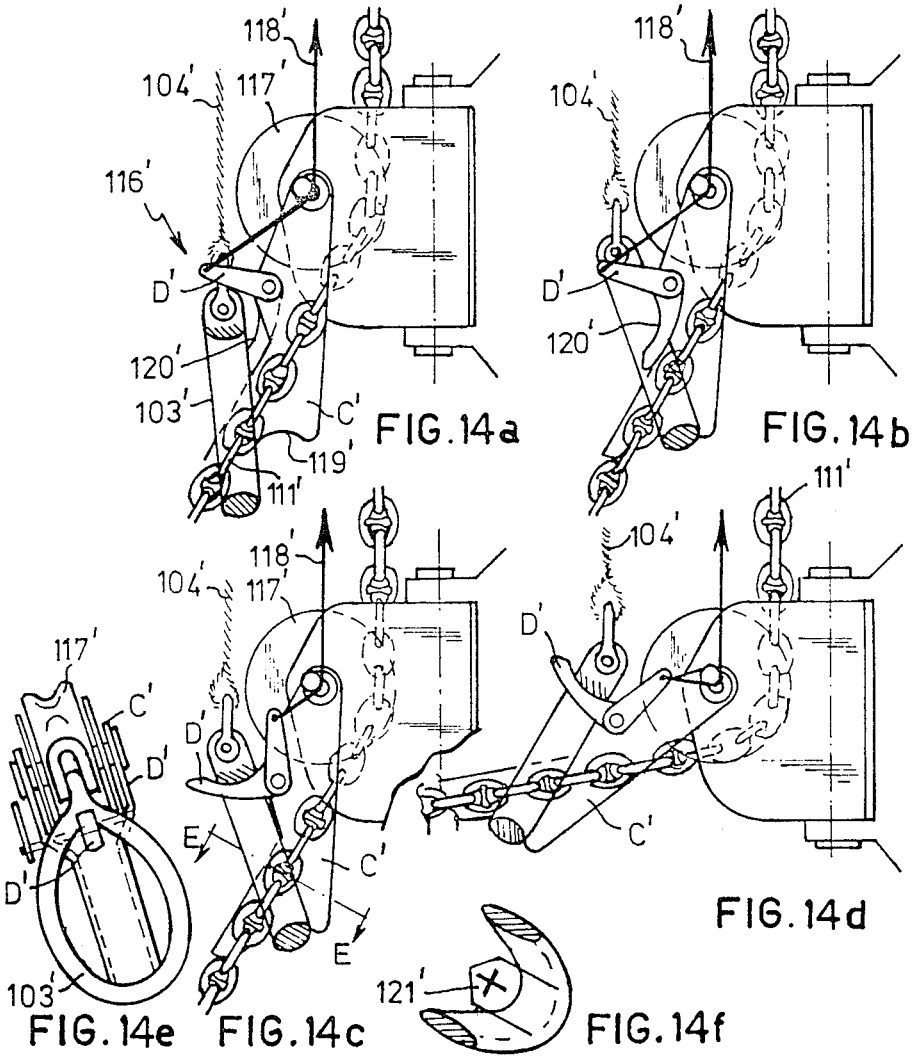

The respective views 14*a*–*d* show four successive pivoting positions of the lever system C',D', FIG. 14*e* is an end view, and FIG. 14*f* is a section through the chaser 103' according to E—E in FIG. 14*f*.

It is seen that the whole construction pivots about the nest sheave 117'.

Having thus described my invention what I claim is:

1. A device for an anchor comprising an anchor shank, which anchor is to be handled by means of a chaser, wherein said chaser is to be paid out to the anchor along an anchor line on a separate chaser line and to be seized on the anchor, said anchor shank and said anchor line being assembled, the device comprising means arranged for turning the anchor about a line lying in a plane of symmetry of the anchor with the chaser resting on an abutment provided on said means, said means being included in the ssembly of said shank and said anchor line, thus allowing an in-line arrangement of said means, said shank and said anchor line.

2. A device according to claim 1, wherein said means for turning the anchor is formed as an arcuate member which is provided with an eye for connection with the anchor line and is connected to the anchor shank.

3. A device according to claim 2, wherein the arcuate member has a substantially semi-circular cross-section, in a plane substantially perpendicular to the plane of symmetry of the anchor.

4. A device according to claim 2, wherein the arcuate member is formed integral with the anchor shank.

5. A device according to claim 2, wherein the arcuate member is formed as a separate member.

6. A device according to claim 5, wherein the end of the arcuate member opposite to the end for connection with the anchor line is formed as a harp shackle.

7. A device according to claim 1, comprising connecting means in the form of a universally pivotal pear eye.

* * * * *